US009090391B2

(12) United States Patent
Horton et al.

(10) Patent No.: US 9,090,391 B2
(45) **Date of Patent: *Jul. 28, 2015**

(54) CONTAINER AND CLOSURE

(71) Applicant: Mead Johnson Nutrition Company, Evansville, IN (US)

(72) Inventors: Thomas C. Horton, Newburgh, IN (US); Robin P. Wiggins, Newburgh, IN (US); Jeffrey Minnette, Evansville, IN (US); Randall Julian, Oakland City, IN (US)

(73) Assignee: Mead Johnson Nutrition Company, Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/739,535

(22) Filed: Jan. 11, 2013

(65) Prior Publication Data

US 2013/0134057 A1 May 30, 2013

Related U.S. Application Data

(63) Continuation of application No. 12/824,447, filed on Jun. 28, 2010, now Pat. No. 8,376,179.

(51) Int. Cl.
*B65D 25/00* (2006.01)
*B65D 83/00* (2006.01)
(Continued)

(52) U.S. Cl.
CPC ..... *B65D 83/00* (2013.01); *B65D 21/022* (2013.01); *B65D 21/0222* (2013.01); *B65D 43/16* (2013.01); *B65D 51/246* (2013.01); *B65D 2203/02* (2013.01)

(58) Field of Classification Search
CPC ..... B65D 21/0222
USPC ..... 206/459.5, 503–513, 47, 229; 220/735, 220/62.22, 212, 522, 521, 574.1, 697, 283, 220/258.1, 702, 23; 40/299.01; 229/1.5, 229/1.5 C; 215/228, 371, 382; 222/109, 222/183; 425/509, 522, 420; 422/509; 428/219–220, 334, 483, 494, 516, 519; 264/509; 24/291, 297, 455, 456–571
IPC ..... B65D 51/24, 43/16, 51/20
See application file for complete search history.

(56) References Cited

U.S. PATENT DOCUMENTS 1,959,600 A 5/1934 Schneider et al.
3,623,634 A * 11/1971 Norgard ..... 206/509
(Continued)

FOREIGN PATENT DOCUMENTS

DE 19815364 9/1999
DE 20120761 3/2002
(Continued)

*Primary Examiner* — Anthony Stashick
*Assistant Examiner* — James M Van Buskirk
(74) *Attorney, Agent, or Firm* — Patterson Intellectual Property Law, P.C.; James R. Cartiglia

(57) ABSTRACT

An improved container provides a container body and a closure. In some embodiments, a scooping utensil retainer is disposed on the closure. The scooping utensil retainer includes opposing flanges protruding from the closure surface. A flange rib protrudes from the first flange into the flange gap, extending from the closure surface to the distal end of the flange. A tapered retainer gap is provided between flanges for resiliently clamping the handle of a scooping utensil. In some embodiments, the closure can include an annular ridge shaped for engaging a downwardly extending skirt on a like container when two like containers are vertically stacked. In some embodiments the container body includes an in-mold label affixed to a substantially straight side wall, the in-mold label covering at least about 95% of the exterior surface area of the container body.

18 Claims, 11 Drawing Sheets

(51) Int. Cl.

| | |
|---|---|
| ***B65D 21/02*** | (2006.01) |
| ***B65D 43/16*** | (2006.01) |
| ***B65D 51/24*** | (2006.01) |

(56) References Cited

U.S. PATENT DOCUMENTS

| | | | | |
|---|---|---|---|---|
| 4,471,881 | A | 9/1984 | Foster | |
| 4,848,714 | A * | 7/1989 | Ziaylek, Jr. et al. | 248/313 |
| 5,052,556 | A * | 10/1991 | Wilkinson | 206/362.2 |
| 5,312,011 | A * | 5/1994 | Fischer | 220/528 |
| 5,314,061 | A | 5/1994 | Bedrossian | |
| 5,368,798 | A | 11/1994 | Mizukoshi et al. | |
| 5,586,656 | A * | 12/1996 | Abrums | 206/501 |
| 5,706,974 | A | 1/1998 | Murdick et al. | |
| 5,788,064 | A | 8/1998 | Sacherer et al. | |
| 6,619,498 | B2 * | 9/2003 | von Holdt, Jr. | 220/276 |
| 6,761,283 | B1 | 7/2004 | Gilliam et al. | |
| 6,772,904 | B1 | 8/2004 | Gilliam et al. | |
| 7,025,520 | B2 * | 4/2006 | Petit | 401/98 |
| 7,040,500 | B2 * | 5/2006 | Kipperman et al. | 220/574.1 |
| 7,185,796 | B2 * | 3/2007 | Parsons | 224/197 |
| 7,464,475 | B2 | 12/2008 | Tsao | |
| 2006/0156811 | A1 | 7/2006 | Borowski et al. | |
| 2008/0041861 | A1 | 2/2008 | Crawford et al. | |
| 2008/0173657 | A1 | 7/2008 | Perry et al. | |
| 2009/0026209 | A1 | 1/2009 | Huntington et al. | |
| 2009/0032545 | A1 | 2/2009 | Zeiler et al. | |
| 2009/0050508 | A1 | 2/2009 | Van Ness | |
| 2010/0308065 | A1 * | 12/2010 | Vandamme et al. | 220/697 |

FOREIGN PATENT DOCUMENTS

| | | |
|---|---|---|
| FR | 2747107 | 10/1997 |
| WO | 2005075314 | 8/2005 |
| WO | 2005082733 | 9/2005 |
| WO | 2005082734 | 9/2005 |
| WO | 2008083141 | 7/2008 |
| WO | 2008149007 | 12/2008 |
| WO | 2009081050 | 7/2009 |
| WO | 2009140627 | 11/2009 |
| WO | 2012047891 | 4/2012 |

* cited by examiner

CONTAINER AND CLOSURE

CROSS-REFERENCE TO RELATED APPLICATION

This application is a Continuation of U.S. patent application Ser. No. 12/824,447 filed Jun. 28, 2010 titled "Improved Container and Closure" all of which is hereby incorporated by reference in its entirety.

BACKGROUND OF THE DISCLOSURE

1. Technical Field

The present disclosure relates to an improved container for storing materials, especially a container having a closure that can be opened for accessing stored content.

2. Background Art

Containers having a lid, or closure, with a structure for retaining a scooping utensil are known in the art, especially containers of the type used for storing consumable materials like food products or dietary supplements. Typically, consumable products of this type are provided in powdered, particulate or granulated form for mixing by the user into an ingestible solution. Conventional containers for storing such content typically include a lid that is opened by the user to access a portion of the stored product. Generally, only a fraction of the stored product is used at any given time, while the remainder is intended for future use. Upon retrieval of a desired amount, the lid is closed against the container to prevent leakage or contamination of the remainder until the next usage. In many applications, the container may be accessed multiple times each day.

In practice, a metered dose is typically dispensed from the container upon opening by scooping the desired amount of product from the container using a scooping utensil such as a spoon, spatula or scoop. Some conventional storage containers known in the art provide a scooping utensil packaged loosely inside the container. Placement of the scooping utensil inside the container conveniently ensures that the user will have a scooping utensil at hand when the stored content is first accessed, eliminating the need for the user to carry an additional spoon or other scooping utensil.

When using a container with a loosely stored scooping utensil, a user typically must first remove the lid and retrieve the scooping utensil from the interior of the container. A loosely stored scooping utensil will often become buried in the stored product. Thus, to retrieve the scoop for measuring and dispensing the desired amount, the user is forced to make contact with the stored product, either directly with the user's hand or indirectly with another object for retrieving the scoop. This aspect of conventional storage containers having loosely stored scooping utensils has several disadvantages. First, the stored content may be contaminated by foreign substances, including bacteria, chemicals or foreign debris present on the user's hand or on the retrieving object. Contamination of the stored product is especially undesirable where the stored content is intended for human consumption. Second, retrieval of the scoop from a buried position exposes the user's hand to the stored content. This is particularly undesirable where the stored content contains ingredients that may cause the stored content to stick to the user's hand. Third, retrieval of the scooping utensil prior to each use is a nuisance to the user, requiring additional time and effort to simply dispense a desired amount of the stored product. When repeated several times each day, retrieval of a buried scooping utensil prior to each use can waste a significant amount of time.

Others have attempted to overcome the problems of conventional storage containers having loosely stored scooping utensils by including mounting structures on the inside of the container or lid for retaining the scooping utensil between uses. Conventional mounting structures for securing a scooping utensil include clasps or locking structures that can make removal of the utensil from the retaining structure difficult. Other conventional retaining structures known in the art provide one or more flanges extending from the container or lid dimensioned for directly engaging the bowl portion of the scoop. However, conventional retaining structures of this type do not allow interchangeability between scooping utensils having varying bowl shapes or dimensions.

Conventional containers for storing material are also often molded from a thermoplastic or thermosetting material. Typically, an injection molding process is used to form the container and/or the lid. During injection molding, a heated thermoplastic or thermosetting material is forced into a mold cavity having a desired container or lid shape defined therein. The heated material fills the contours of the mold cavity and is allowed to cool, producing a continuous, solid three-dimensional structure. The container is then removed from the mold for packaging and labeling.

In-mold labeling is a technique for the injection molding of thermoplastic containers, where during an in-mold labeling process, a label is typically inserted into the injection mold cavity prior to injection of the heated material into the cavity. The label is inserted with the front, or face, of the label oriented toward the outer cavity wall, and the back of the label is oriented toward the interior of the mold cavity. During molding, the label can be secured to the outer wall of the mold cavity using a releasable means, for example by a vacuum or electrostatic force between the in-mold label and the mold cavity wall. The molding material is then forced into the mold cavity to fill the space between the back of the label and the inner mold cavity wall. The mold material fills the space behind the label and bonds directly to the label, forming a container having a label integrated on the exterior surface. One characteristic of a container with an in-mold label is that the container generally includes a label affixed to the container surface prior to filling the container with the stored product.

Conventional in-mold labeling configurations for injection molding containers require the mold cavity to include an angled side wall or a relatively large draft angle, i.e. greater than about five degrees, for reliably inserting a label into the mold cavity before each injection step. Additionally, using conventional in-mold labeling configurations, if a substantially straight side wall or lower draft angle is desired, the label height must be reduced, as taller labels tend to become stuck in a low draft angle mold cavity. Yet further, in-mold labeling configurations having substantially straight or low draft angle mold cavities typically do not accommodate glossy exterior label surfaces because the glossy finish can cause the in-mold label to cling to the mold walls during insertion, resulting in undesirable folding of the label or misalignment.

There is a continuing need for improvements in various aspects of the containers discussed above.

BRIEF SUMMARY

One embodiment of the present disclosure provides a container for storing material. The container includes a container body including a side wall defining an opening in the container and a closure engaging the container body. The closure defines an interior closure surface. A utensil handle retainer is disposed on the interior closure surface. The utensil handle retainer includes a first flange having a first distal end protruding from the interior closure surface. The first flange includes a first flange rib protruding from the first flange, and the first flange rib extends from the interior closure surface to the first distal end. A second flange having a second distal end also protrudes from the interior closure surface. The second flange includes a second flange rib protruding from the second flange toward the first flange, and the second flange rib extends from the interior closure surface to the second distal end.

Another embodiment of the present disclosure provides a container for storing material. The container includes a container body having a side wall defining an opening for accessing the matter. A closure is attached to the container body. A base is attached to the side wall, and a skirt extends coextensively downward from the side wall substantially surrounding the base. The skirt includes a skirt end defining an inner skirt perimeter. An annular ridge extends upward from the closure. The annular ridge is shaped to mate with the inner skirt perimeter of a like container when two like containers are vertically stacked.

Yet another embodiment of the present disclosure provides a container for storing material. The container includes a container body having a side wall defining an opening in the container, the side wall being substantially perpendicular to a transverse reference plane. A closure is pivotally attached to the container body, and the closure includes an interior closure surface and an annular ridge protruding upward from the closure. A scooping utensil retainer is disposed on the interior closure surface, and a skirt extends coextensively downward from the side wall. The skirt is oriented in substantially the same local plane as the side wall. An in-mold label is disposed on the side wall.

Another embodiment of the present disclosure provides a container for storing materials. The container includes a container body defining an interior region and a closure engages the container body. A scooping utensil is disposed in the interior region, and the scooping utensil includes a utensil handle having a handle thickness B. A utensil handle retainer is disposed on the closure. The utensil handle retainer includes first and second opposing flanges protruding from the closure. The first and second flanges define a tapered retainer gap therebetween. The tapered retainer gap includes a minimum gap width A. The utensil handle retainer defines a handle interference ratio equal to handle thickness B divided by minimum gap width A, and the handle interference ratio is greater than about 1.0.

Numerous other objects, features and advantages of the present disclosure will be readily apparent to those skilled in the art upon a reading of the following disclosure when taken in conjunction with the accompanying drawings.

DETAILED DESCRIPTION

Figure 1:
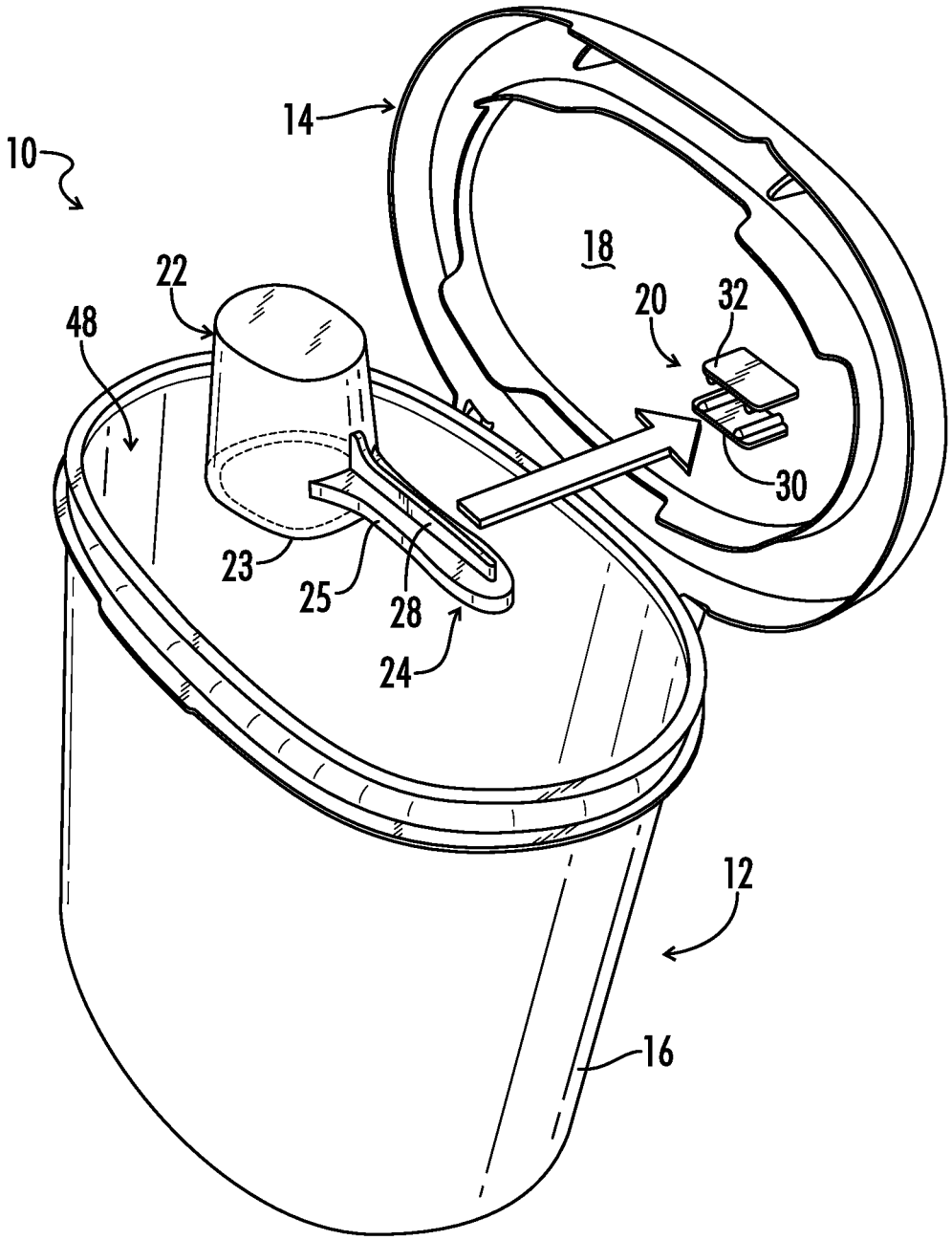
FIG. 1 illustrates a perspective view of one embodiment of a container.

Referring now to the drawings and particularly to FIG. 1, a perspective view of a container in an open position is shown and generally designated by the numeral 10. In the drawings, not all reference numbers are included in each drawing, for the sake of clarity. In addition, positional terms such as "upper," "lower," "side," "top," "bottom," "vertical," "horizontal," etc. refer to the container when in the orientation shown in the drawing. The skilled artisan will recognize that containers in accordance with the present disclosure can assume different orientations when in use.

Figure 8:
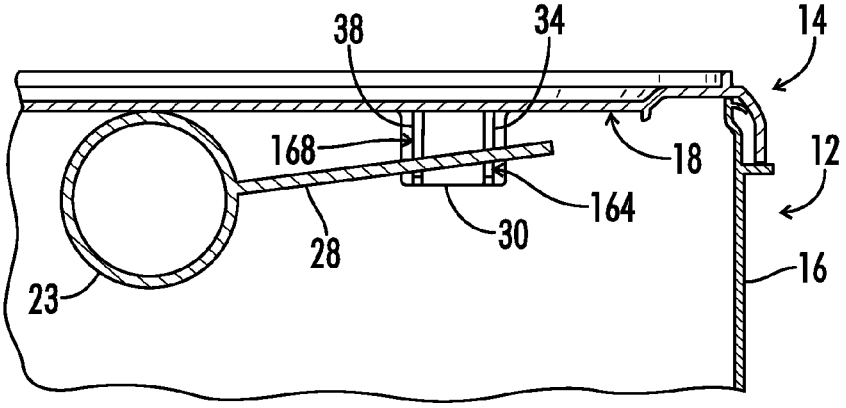
FIG. 8 illustrates a detail partial cross-sectional view of one embodiment of a container showing Section 8-8 from FIG. 7.

As seen in FIG. 1, container 10 includes a container body 12 having a side wall 16. Side wall 16 defines an opening 48 in container body 12. In one embodiment, side wall 16 forms an oval cross-sectional shape. It is understood that other embodiments of container body 12 can include other cross-sectional shapes, including circular, rectangular, or other linear or curvilinear shapes not shown. A closure, or lid 14, is associated with and generally mates with container body 12. Closure 14 includes an interior closure surface 18 spanning the opening 48 when the lid is in the closed position, as seen in FIG. 8. In some embodiments, closure 14 is pivotally attached to container 12 by one or more pivoting hinges. Closure 14 can be removed or pivoted away from container body 12 by a user for accessing material stored in container body 12.

Figure 5:
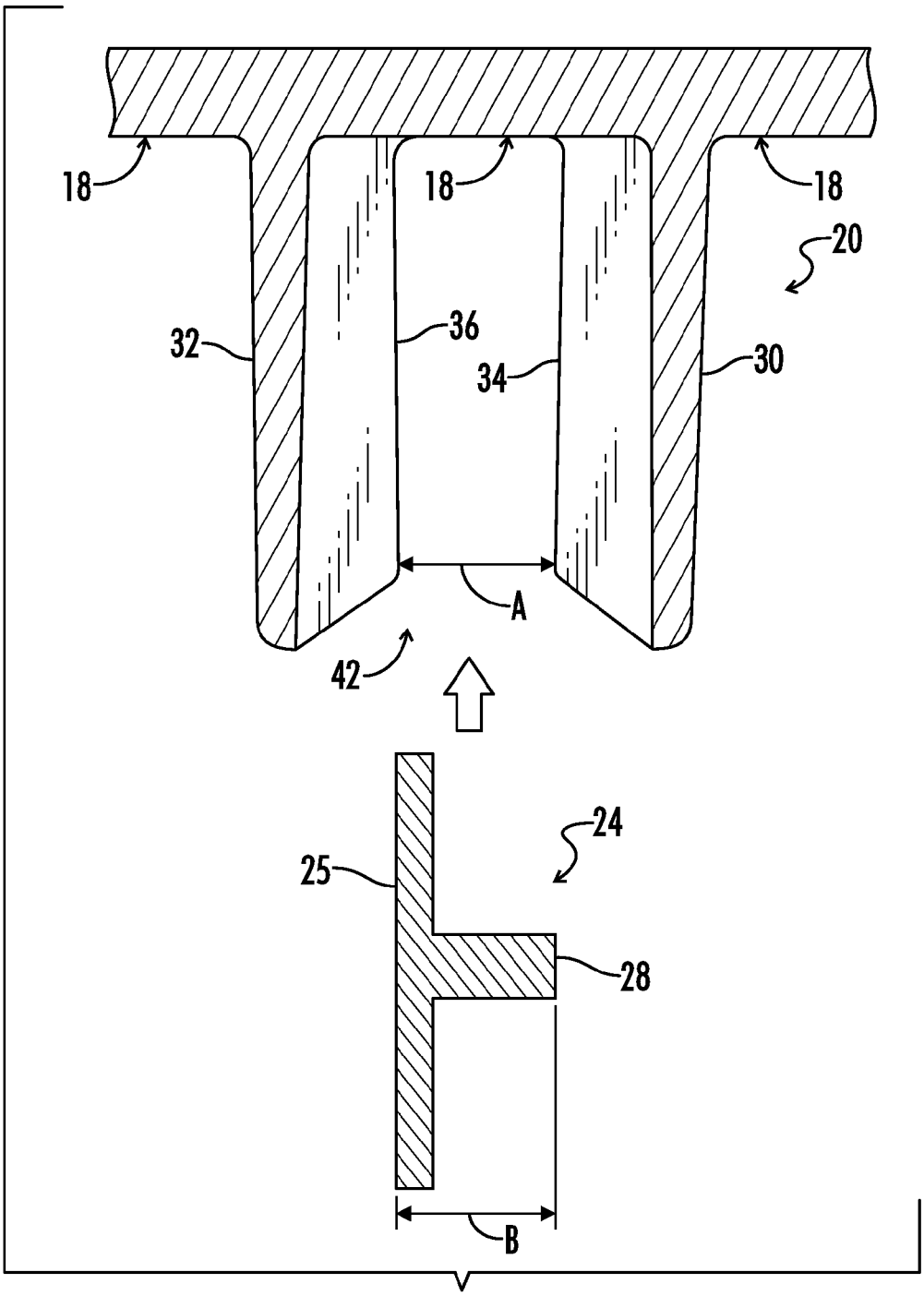
FIG. 5 illustrates a partial exploded cross-sectional view of one embodiment of a utensil handle retainer and one embodiment of a mating utensil handle.

Also seen in FIG. 1, in some embodiments a scooping utensil 22 is releasably secured to closure 14 by a utensil handle retainer 20 protruding from interior closure surface 18. In certain embodiments, utensil handle retainer 20 is integrally molded on closure 14. Scooping utensil 22 generally includes a utensil handle 24 attached to a utensil bowl, or utensil reservoir 23. Handle 24 of scooping utensil 22 in some embodiments includes a handle body 25 and a handle rib 28 extending from handle body 25, as seen in FIG. 1 and FIG. 5. It is understood that, in some embodiments not shown, utensil handle retainer 20 can be positioned at various other locations on container 10.

Figure 2:
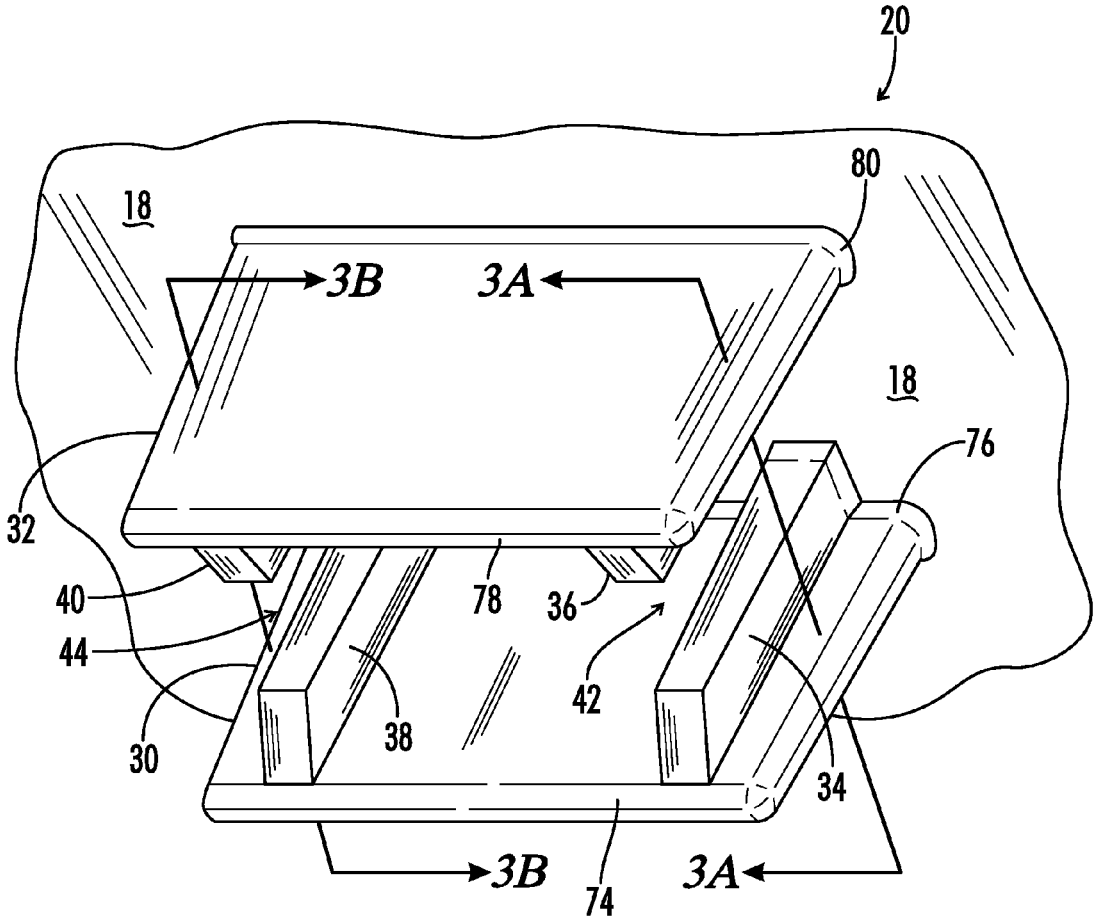
FIG. 2 illustrates a detail partial perspective view of one embodiment of a utensil handle retainer.

Referring now to FIG. 2, the utensil handle retainer 20 is schematically illustrated protruding from interior closure surface 18. Utensil handle retainer 20 includes a first flange 30 and a second flange 32 protruding generally outward from interior closure surface 18. First flange 30 includes a first distal end 74 positioned away from interior closure surface 18 and a first proximal end 76 positioned where first flange 30 meets interior closure surface 18. First proximal end 76 is thus located nearer interior closure surface 18 than first distal end 74. A first flange rib 34 protrudes from first flange 30. In one embodiment, first flange rib 34 extends from interior closure surface 18 to first distal end 74 along the entire height of first flange 30, as illustrated in FIG. 2.

Also seen in FIG. 2, a second flange 32 protrudes from interior closure surface 18. Second flange 32 includes a second distal end 78 located away from interior closure surface 18 and a second proximal end 80 located where second flange 32 meets interior closure surface 18. Second proximal end 80 is thus located nearer interior closure surface 18 than second distal end 78. A second flange rib 36 protrudes from second flange 32 generally toward first flange 30. Second flange rib 36 in some embodiments extends from interior closure surface 18 to second distal end 76 along the entire height of second flange 32, also seen in FIG. 3A, illustrating a detail cross sectional view of Section 3A-3A from FIG. 2.

Referring again to FIG. 2, in some embodiments, a first tapered retainer gap 42 is defined between first and second flange ribs 34, 36. First tapered retainer gap 42 is generally shaped for receiving handle 24 of scooping utensil 22.

Figure 3A:
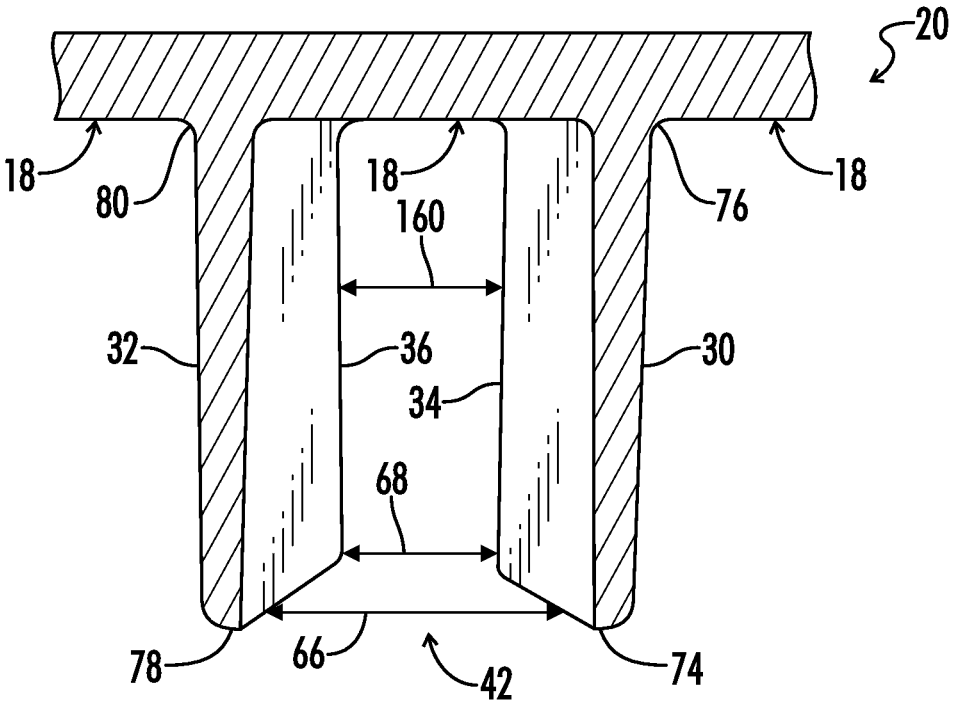
FIG. 3A illustrates a detail partial cross sectional view of one embodiment of a utensil handle retainer from Section 3A-3A seen in FIG. 2.

In some embodiments, as seen in FIG. 3A, first tapered retainer gap 42 includes a first converging gap section defining a first gap width 66 and a second gap width 68. The first gap width 66 is defined nearer the first distal end 74 than the second gap width 68, and the first gap width 66 is greater than the second gap width 68. The first converging gap section defined between first and second flange ribs 34, 36 causes a self-centering, or funneling, effect when the utensil handle 24 is inserted into the first tapered retainer gap 42. This self-centering, or funneling, effect caused by the first converging gap section provides convenient storage of the utensil handle 24 and prevents the user from having to precisely align the handle 24 with the tapered retainer gap 42 during insertion of the handle 24 into the gap.

Figure 3B:
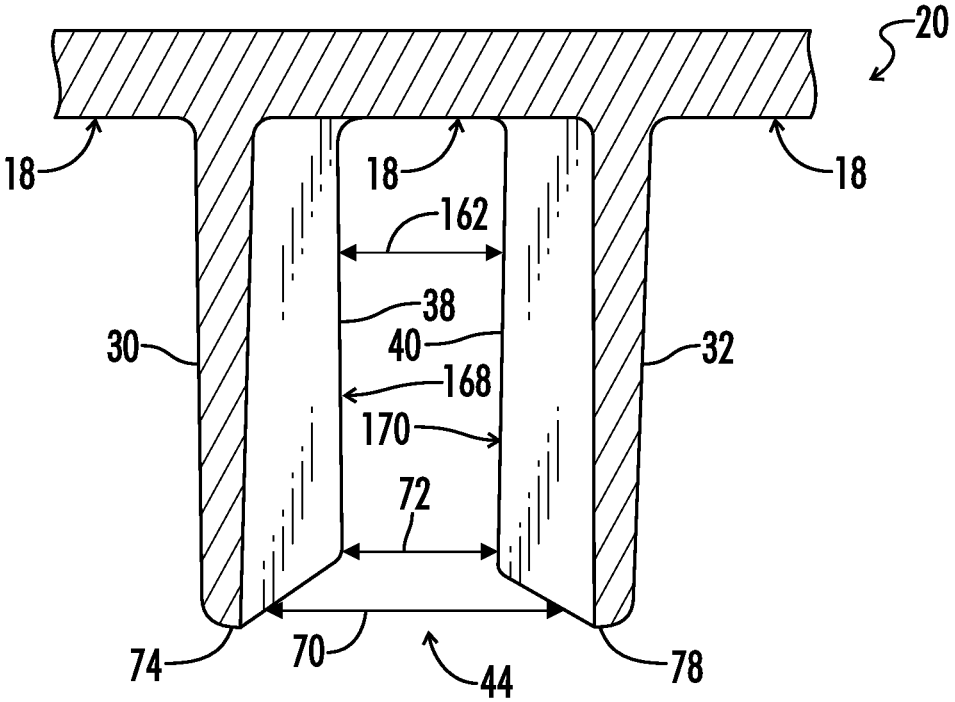
FIG. 3B illustrates a detail partial cross-sectional view of one embodiment of a utensil handle retainer from Section 3B-3B seen in FIG. 2.

As seen in FIG. 2, in some embodiments, utensil handle retainer 20 includes a third flange rib 38 protruding from first flange 30 and a fourth flange rib 40 protruding from second flange 32. A second tapered retainer gap 44 is defined between third and fourth flange ribs 38, 40. Referring to FIG. 3B, a partial cross-sectional view of Section 3B-3B from FIG. 2 is illustrated. Second tapered retainer gap 44 in some embodiments defines a second converging gap section including a fourth gap width 70 and a fifth gap width 72. Fifth gap width 72 is defined nearer interior closure surface 18 than fourth gap width 70, and fifth gap width 72 is less than fourth gap width 70. The second converging gap section defined by fourth and fifth gap widths 70, 72 also creates a self-centering, or funneling, effect, in combination with the effect created by the first converging gap section. Together, the first and second converging gap sections provide enhanced ease of use when securing a utensil handle to the utensil handle retainer. In some embodiments, first flange 30, second flange 32, and first, second, third and fourth flange ribs 34, 36, 38, 40 are all integrally molded on closure 14.

Figure 4:
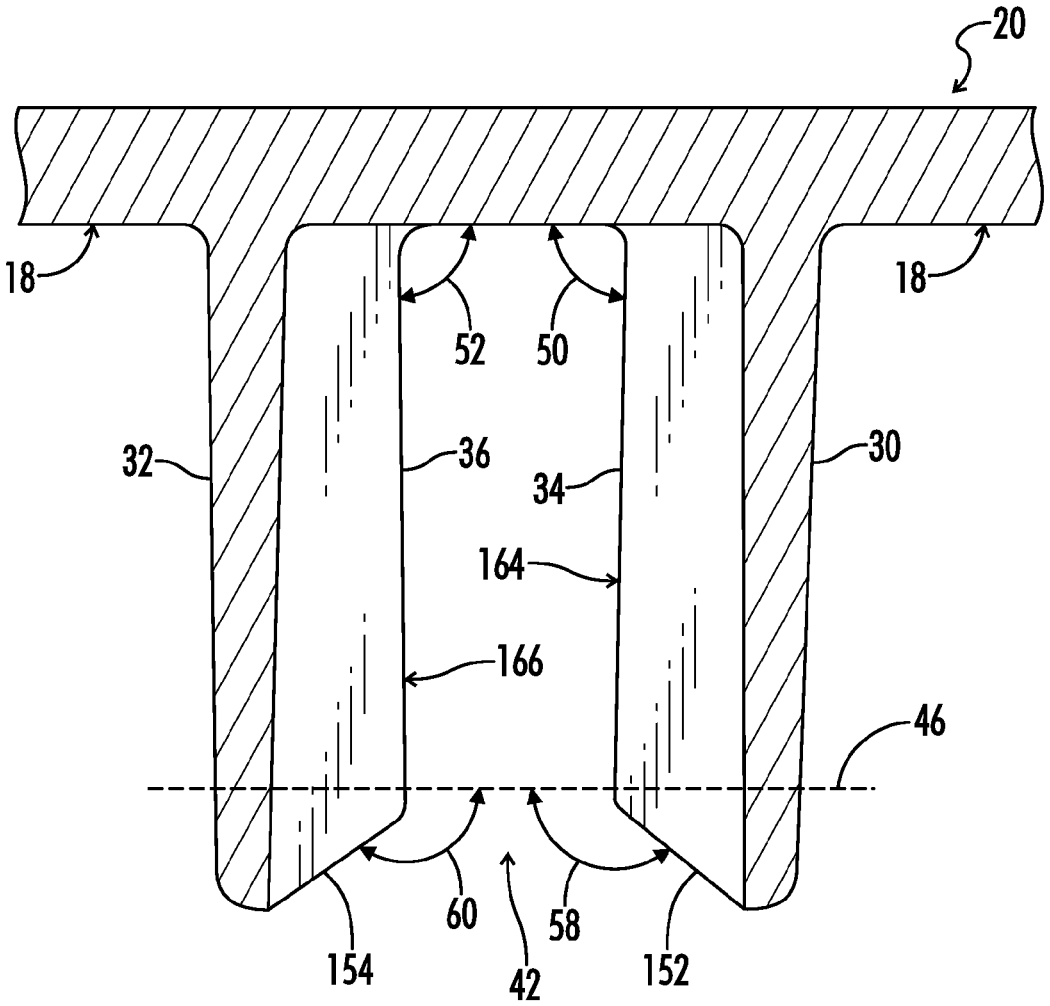
FIG. 4 illustrates a detail partial cross-sectional view of one embodiment of a utensil handle retainer.

Referring now to FIG. 4, in some embodiments, first flange rib 34 includes a first beveled end 152 oriented at a first bevel angle 58 relative to a reference axis 46. Reference axis 46 is aligned substantially parallel to interior closure surface 18. Second flange rib 36 in some embodiments also includes a second beveled end 154 oriented at a second bevel angle 60 relative to reference axis 46. In some embodiments, first and second bevel angles 58, 60 are substantially equal. In some embodiments, first and second bevel angles 58, 60 ranging between about 110 degrees and about 170 degrees are suitable for providing the desired self-centering, or funneling, effect experienced when handle 24 is inserted into first tapered retainer gap 42, as illustrated in FIG. 5.

Referring to FIG. 5, utensil handle retainer 20 includes a minimum gap distance A defined at the narrowest distance between first and second flanges 30, 32. Minimum gap distance A in some embodiments is defined at the narrowest point between first and second flange ribs 34, 36 in the first converging gap section of first tapered retainer gap 42. Utensil handle 24 generally includes a utensil handle thickness B, as seen in FIG. 5. In some embodiments, utensil handle 24 includes a handle body 25 and a handle rib 28 protruding from handle body 25, as best seen in FIG. 1. Handle thickness B in this configuration is defined as the thickness of handle body 25 plus the thickness of handle rib 28.

Handle Interference Ratio

A handle interference ratio is defined as the handle thickness B divided by minimum gap distance A. In some embodiments, handle interference ratio is greater than about 1.0. Generally, during use, utensil handle 24 is inserted between first and second flanges 30, 32. First and second flanges 30, 32, and first, second, third and fourth flange ribs 34, 36, 38, 40 in one embodiment include a thermoplastic polymer material, for example polypropylene. As such, first and second flanges 30, 32, and flange ribs 34, 36, 38, 40 are resiliently flexible and are capable of bending in an elastic range without undergoing plastic deformation. In one embodiment, flange ribs 34, 36, 38, 40 provide additional stiffness, or resistance to flex, to first and second flanges 30, 32 during resilient bending.

Figure 6:
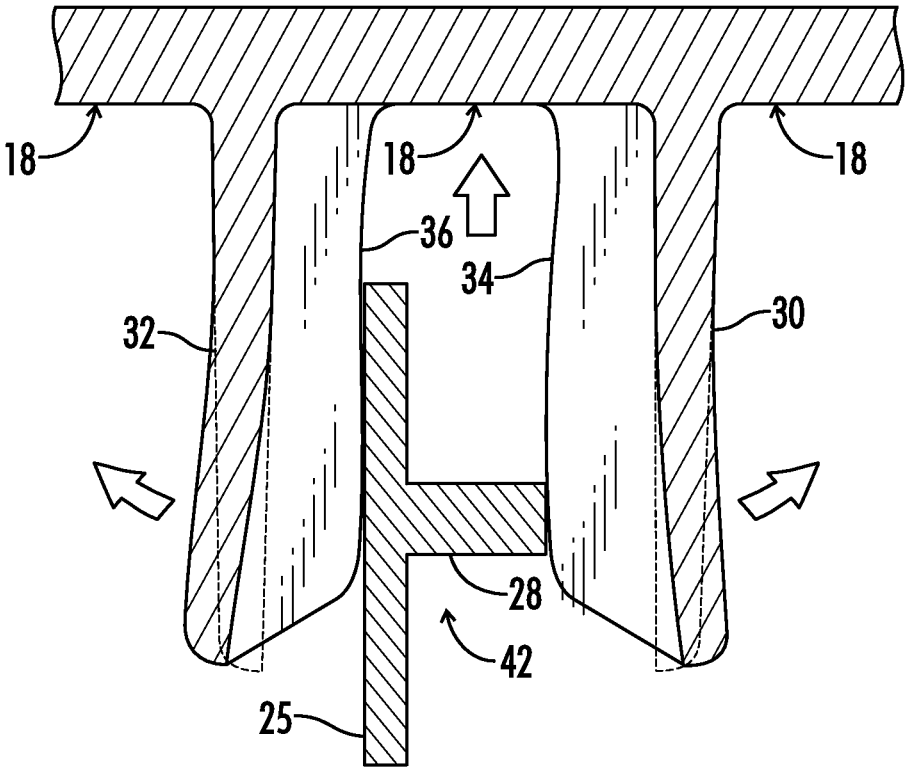
FIG. 6 illustrates a detail partial cross-sectional view of one embodiment of a utensil handle retainer with one embodiment of a partially-secured utensil handle.

Generally, the user will insert handle 24 into flange gap 42 after each use to store the scooping utensil 22 until future use. Storage prevents scooping utensil 22 from becoming buried in the stored content. As seen in FIG. 6, when the handle interference ratio is greater than about 1.0, the first and second flanges 30, 32 are pushed apart when handle 24 is inserted into first tapered retainer gap 42. Thus, the first and second flanges 30, 32 resiliently press against handle 24 during insertion, providing a compressive, or clamping, force against handle 24. Because the clamping force can be applied across a range of interference ratios, the utensil handle retainer 20 can be used to secure handle 24 to closure 14 over a wide range of manufacturing tolerances, thereby reducing manufacturing costs associated with precision manufacturing of utensil handle 24 and utensil handle retainer 20. In one embodiment, utensil handle 24 does not contact first or second flanges 30, 32, but is rather engaged directly by one or more of first, second, third and fourth flange ribs 34, 36, 38, 40. Although there is technically no upper limit to handle interference ratio, B divided by A, a practical upper limit is seen at around 3.0. In some embodiments, a handle interference ratio no greater than about 1.2 provides adequate clamping force while providing suitable dimensional interference for easily securing utensil handle 24 to utensil handle retainer 20.

Diverging Section

Referring again to FIG. 3A, in some embodiments, first tapered retainer gap 42 includes a third gap width 160 defined between first and second flange ribs 34, 36. Third gap width 160 in some embodiments is greater than second gap width 68 and is defined nearer interior closure surface 18 than second gap width 68. Third gap width 160 defines a diverging section of first tapered gap 42 between second gap width 68 and interior closure surface 18.

Similarly, in some embodiments, seen for example in FIG. 3B, second tapered retainer gap 44 includes a sixth gap width 162 defined between third and fourth flange ribs 38, 40. Sixth gap width 162 in some embodiments is greater than fifth gap width 72 and is defined nearer interior closure surface 18 than fifth gap width 72. Sixth gap width 162 defines a diverging section of second tapered retainer gap 44 located between the location of fifth gap width 72 and the interior closure surface 18.

As seen in FIG. 4, first flange rib 34 includes a first rib surface 164 substantially facing first tapered retainer gap 42. First rib surface 164 is oriented at a first taper angle 50 relative to interior closure surface 18. In some embodiments, first taper angle 50 is between about ninety and about sixty degrees. Similarly, referring to FIG. 4, in certain embodiments, second flange rib 36 includes a second rib surface 166 substantially facing tapered retainer gap 42. Second rib surface 166 is oriented at a second taper angle 52. In some embodiments, second taper angle 52 is between about ninety and about sixty degrees. In yet other embodiments, first and second taper angles 50, 52 are substantially equal.

As utensil handle 24 is clamped, or squeezed, between resilient first and second flanges 30, 32, and more particularly between first and second flange ribs 34, 36 in some embodiments, an acute first taper angle 50 enhances securement of utensil handle 24 by pushing utensil handle 24 toward interior closure surface 18, as seen in FIG. 6. In some embodiments, first and second taper angles 50, 52, seen in FIG. 4, are both acute and are no less than about eighty degrees. In yet another embodiment, first and second taper angles 50, 52 between about eight-nine degrees and about eighty-five degrees are sufficient to push handle 24 toward interior closure surface 18 for securely retaining utensil handle 24 in utensil handle retainer 20. It will be appreciated that in some embodiments, friction between handle 24 and utensil handle retainer 20 is sufficient to securely retain handle 24 between first and second flanges 30, 32.

Figure 7:
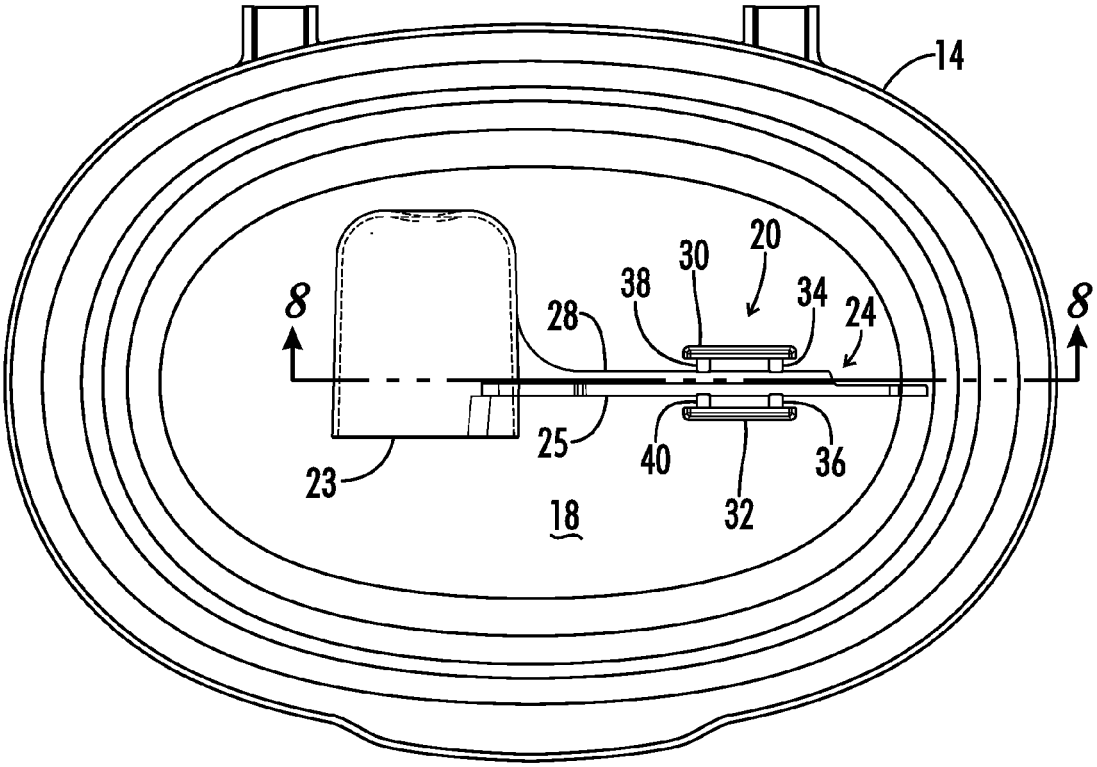
FIG. 7 illustrates a partial plan view of one embodiment of a closure with one embodiment of a scooping utensil.

Referring now to FIG. 7, a utensil handle 24 is shown generally secured in utensil handle retainer 20 between first and second flanges 30, 32. More specifically, utensil handle 24 is secured between first and second flange ribs 34, 36, and also between third and fourth flange ribs 38, 40. As seen in FIG. 8, in some embodiments, handle rib 28 engages flange ribs 34 and 38. Accordingly, in some embodiments, handle rib 28 is positioned in the diverging sections of first and second tapered retainer gaps 42, 44, seen in FIGS. 3A and 3B. Positioning of handle rib 28 in the diverging sections of each tapered retainer gap 42, 44 provides additional clamping force to utensil handle 24 for effectively securing scooping utensil 22 to utensil handle retainer 20 without requiring additional structure for engaging the utensil bowl 23. This aspect of the present disclosure allows utensils with various sized bowls to be interchangeably used with one utensil retainer configuration.

Curved Interior Corner

Figure 9:
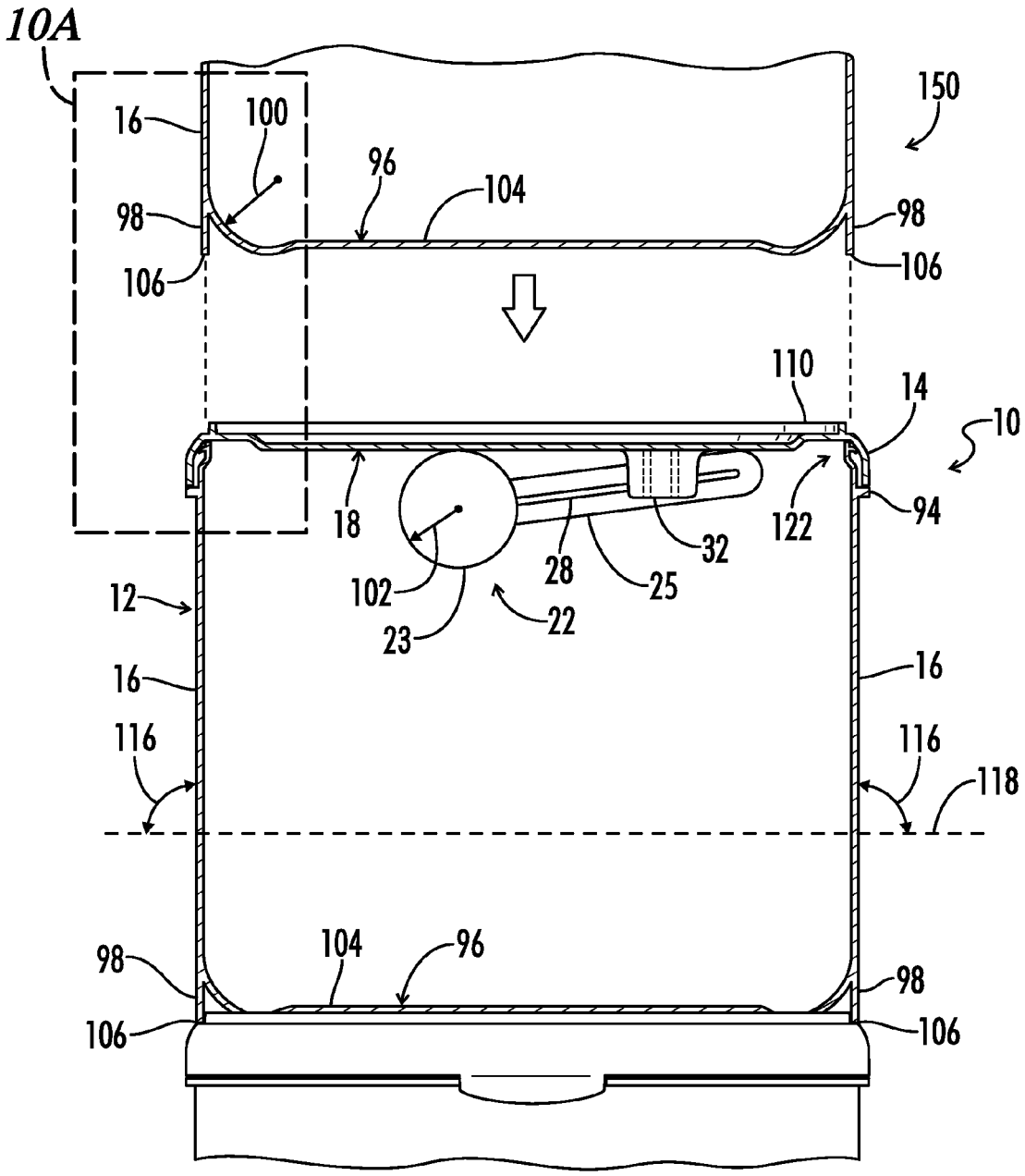
FIG. 9 illustrates an exploded partially broken away elevation view of one embodiment of multiple like containers in a vertically stacked configuration.

Referring now to FIG. 9, container body 12 includes side wall 16 oriented at a side wall angle 116 relative to horizontal reference axis 118. In one embodiment, side wall angle 116 is substantially perpendicular to horizontal reference axis 118. In another embodiment, side wall angle 116 is between about eighty degrees and about ninety degrees. In yet another embodiment, side wall angle 116 is substantially between about eighty-five and about eighty-nine degrees. A base 104 is attached to side wall 116. Base 104 forms bottom interior surface 96 of the container body 12. The base 104 includes a rounded interior corner defining a first radius of curvature 100 between the side wall 16 and the bottom interior surface 96 of container body 12. In one embodiment, first radius of curvature 100 is between about ten millimeters and about thirty millimeters. The rounded interior corner of base 104 allows enhanced removal of the last amount of any remaining material from container body 12 using scooping utensil 22. Also seen in FIG. 9, scooping utensil 22 includes a utensil bowl 23 having a second radius of curvature 102. In one embodiment, the first radius of curvature 100 is substantially equal to the second radius of curvature 102. It is understood that in some embodiments the utensil bowl 23 can be made of a resilient material that flexibly contours to the first radius of curvature 100.

Vertical Nesting Configuration

Another aspect of the present disclosure provides a container apparatus having a nesting configuration for stacking multiple like containers in a vertical assembly, as seen in FIG. 9. The vertical nesting configuration facilitates improved display on store or home shelves and improved packaging by preventing like containers from sliding horizontally relative each other when stacked. Generally, side wall 16 includes a skirt 98 protruding downward from side wall 16. Skirt 98 is coextensive with and is oriented in substantially the same plane as side wall 16. In one embodiment, skirt 98 forms a continuous annular ring surrounding base 104. Skirt 98 includes a skirt end 106 defining the lowest edge of skirt 98. Skirt 98 and side wall 16 define an exterior surface area on container body 12. The exterior surface area is defined as the surface area on the container body between lateral rim 94 and skirt end 106.

Figure 10A:
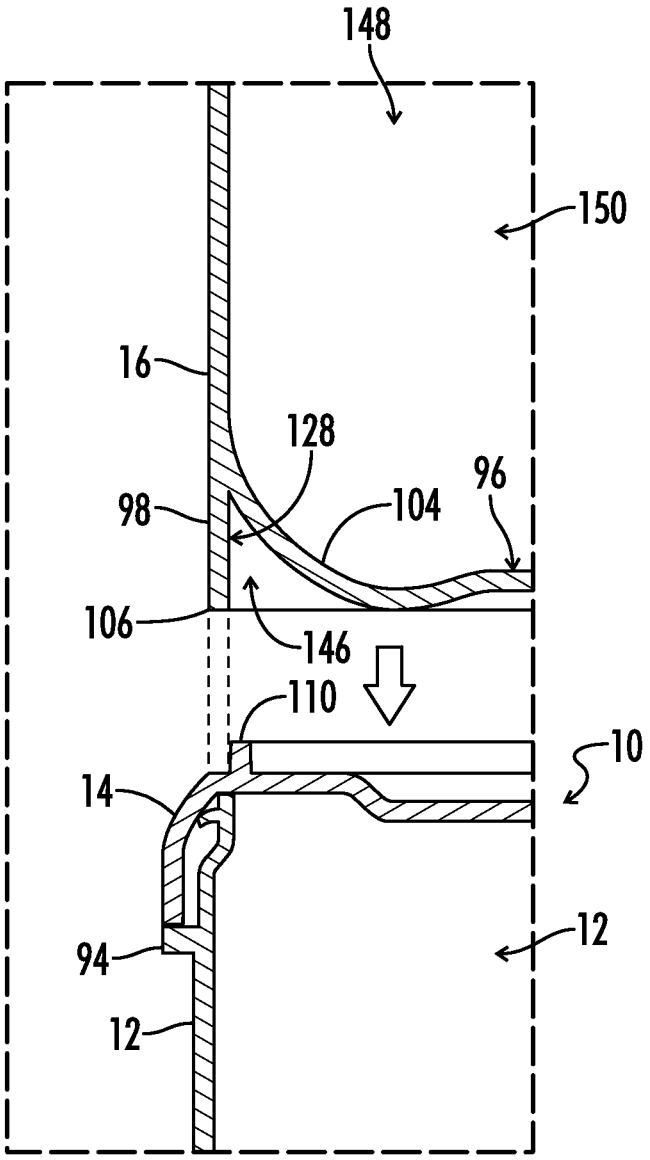
FIG. 10A illustrates a detail partial cross-sectional view of one embodiment of two like containers from FIG. 9.
Figure 10B:
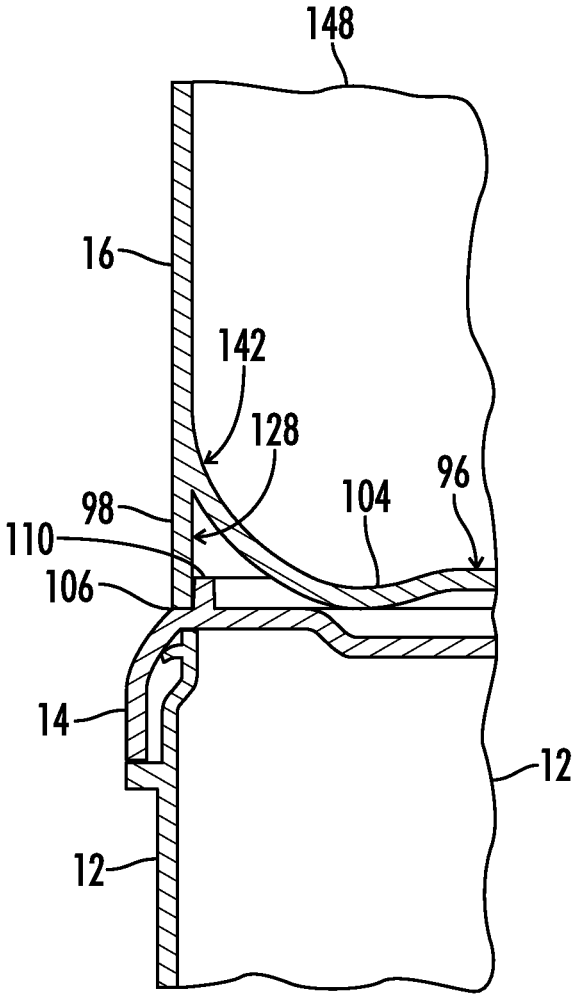
FIG. 10B illustrates a detail partial cross-sectional view of one embodiment of two like containers in a vertically stacked configuration.
Figure 10C:
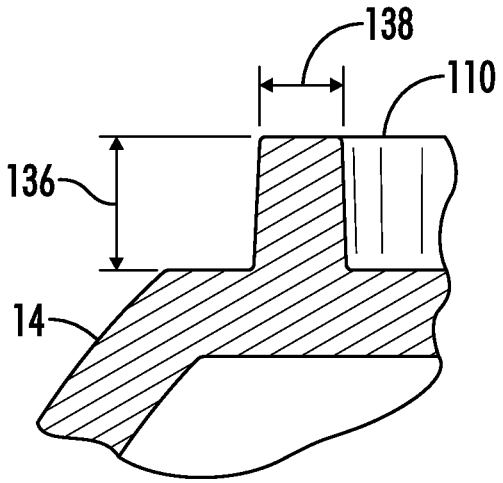
FIG. 10C illustrates a detail partial cross-sectional view of one embodiment of an annular ridge.

A first stackable container apparatus 10 generally includes a closure 14, or lid, having an annular ridge 110 protruding upward therefrom. The annular ridge 110 is shaped for engaging the skirt 98 on a like container, as seen in FIG. 9 and FIG. 10A. A second like container 150, having a second container body 148, is positioned above lid 14 of container 10 in a vertically stacked configuration, as seen in detail in FIG. 10A. The second container body 148 includes skirt 98 protruding downward from side wall 16. Skirt 98 includes a skirt end 106 forming a lower annular edge of skirt 98. Skirt end 106 is shaped for engaging annular ridge 110, as seen in FIG. 10B. In an embodiment, skirt end 106 surrounds annular ridge 110 when second container body 148 is positioned on lid 14. Also seen in FIG. 10B, a base 104 is attached to side wall 16 at a base attachment location 142. Skirt 98 generally extends downward from the intersection between base 104 and side wall 16. In one embodiment, skirt 98 defines an inner skirt surface 128, seen in FIG. 10A, substantially facing base 104. A base gap 146 is defined between inner skirt surface 128 and base 104. Annular ridge 110 is shaped to fit in base gap 146. As seen in FIG. 10C, annular ridge 110 includes a ridge height 136 and a ridge width 138. In one specific embodiment, ridge height 136 is between about two to about four millimeters and ridge width 138 is between about one to about two millimeters.

In-Mold Label

Figure 11:
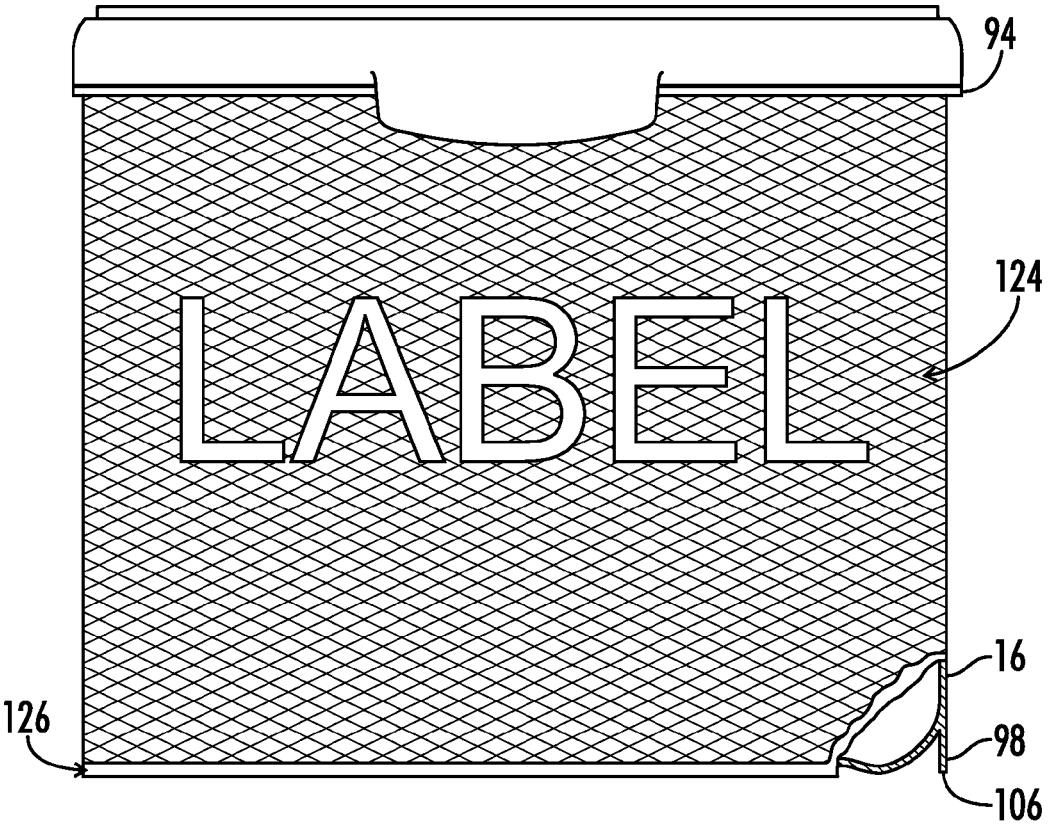
FIG. 11 illustrates a partially broken away view of one embodiment of a container.

Referring now to FIG. 11, container body 12 includes a lateral rim 94 protruding outward from container body 12. In one embodiment, lateral rim 94 extends continuously around the perimeter of container body 12. In some embodiments, the exterior surface area of container body 12 is covered by a label 124. The label 124 partially covers exterior surface area between lateral rim 94 and skirt end 106. Label 124 can be an in-mold label affixed to the exterior surface area by an in-mold labeling process wherein container body 12 is formed by injection molding of a thermoplastic or thermosetting material. In some embodiments, the container body 12 is formed by forcing heated thermoplastic or thermosetting material into an injection mold cavity and allowing the material to cool, forming a solid shape. Label 124 is inserted into the mold cavity prior to forcing the thermosetting or thermoforming material into the mold cavity. Label 124 in one embodiment is cut from a roll of in-mold labels immediately prior to insertion into the vacant injection mold cavity. In another embodiment, label 124 includes a glossy exterior surface finish, as opposed to a matte finish. When container body 12 is removed from the mold cavity, label 124 is integrally affixed directly to exterior surface area of container body 12. This technique is referred to as in-mold labeling. In one embodiment, the label 124 covers at least about ninety-five percent of exterior surface area of the container body 12 between lateral rim 94 and skirt end 106. In another embodiment, label 124 extends from the lateral rim 94 to a distance above the skirt end 106, leaving an unlabeled region 126 on the container body 12. In yet another embodiment, unlabeled region 126 constitutes less than about one percent of exterior surface area of container body 12.

Several advantages are offered by a container 10 having substantially straight side walls, a low draft angle and a glossy label covering a large portion, i.e. greater than about 95%, of the exterior surface area on the container body 12. First, a straight side wall 16 and low draft angle improves bulk volumetric container packaging efficiency, allowing more containers to be positioned adjacent one another in a fixed space on store shelves or in shipping containers. Second, a glossy label is more appealing to customers. Third, maximizing the label coverage on the exterior side wall surface area improves the overall aesthetic design and provides more area for informational or decorative label content.

Thus, although there have been described particular embodiments of the present invention of a new and useful Improved Container and Closure, it is not intended that such references be construed as limitations upon the scope of this invention except as set forth in the following claims.

What is claimed is:

1. A container for storing material, the container comprising:

a container body defining an interior region for storing material;

a closure engaging the container body, the closure defining an interior closure surface;

a scooping utensil disposed in the interior region, the scooping utensil including a utensil handle having a handle thickness;

a utensil handle retainer disposed on the closure, the utensil handle retainer including first and second opposing flanges protruding from the closure;

a first flange rib extending from the interior closure surface and having a first rib surface protruding from the first flange toward the second flange, the first flange rib surface defining a first taper angle between the first flange rib and the interior closure surface, wherein the first taper angle is between about ninety degrees and about sixty degrees;

a first tapered retainer gap defined between the first and second flanges, the first tapered retainer gap including a minimum gap width; and wherein the utensil handle retainer defines a handle interference ratio equal to handle thickness divided by minimum gap width, and wherein the handle interference ratio is greater than 1.0.

2. The container of claim 1, wherein the handle interference ratio is between 1.0 and 1.2.

3. The container of claim 1, wherein the first tapered retainer gap includes a diverging section located between the minimum gap width and the closure.

4. The container of claim 1, further comprising a second flange rib protruding from the second flange toward the first flange.

5. The container of claim 4, wherein the first tapered retainer gap is defined between the first and second flange ribs.

6. The container of claim 4, further comprising a third flange rib protruding from the first flange toward the second flange.

7. The container of claim 6, further comprising a fourth flange rib protruding from the second flange toward the first flange.

8. The container of claim 7, further comprising a second tapered retainer gap defined between the third and fourth flange ribs.

9. The container of claim 1, which further comprises:

a container body having a side wall;

a base attached to the side wall;

a skirt extending coextensively downward from the side wall substantially surrounding the base, the skirt including a skirt end defining an inner skirt surface substantially facing the base; and an annular ridge extending upward from the closure, the annular ridge having a ridge height and a ridge width less than the ridge height, the annular ridge shaped to mate with the inner skirt surface of a like container when two like containers are vertically stacked.

10. The container of claim 9, further comprising the base including a bottom interior surface.

11. The container of claim 10, further comprising a rounded interior corner defining a first radius of curvature between the side wall and the bottom interior surface.

12. The container of claim 11, wherein the scooping utensil has a utensil bowl.

13. The container of claim 12, wherein the utensil bowl has a second radius of curvature.

14. The container of claim 13, wherein the first radius of curvature is substantially equal to the second radius of curvature.

15. The container of claim 14, wherein the first radius of curvature is between about ten millimeters and about thirty millimeters.

16. The container of claim 11, further comprising a base gap defined between the inner skirt surface and the base.

17. The container of claim 16, wherein the annular ridge is shaped to fit in the base gap of a like container when two containers are vertically stacked.

18. The apparatus of claim 17, wherein the inner skirt surface surrounds and contacts the annular ridge when the annular ridge is positioned in the base gap.

* * * * *